US006794963B2

(12) United States Patent
O'Keeffe et al.

(10) Patent No.: US 6,794,963 B2
(45) Date of Patent: Sep. 21, 2004

(54) MAGNETIC DEVICE FOR A MAGNETIC TRIP UNIT

(75) Inventors: Thomas Gary O'Keeffe, Farmington, CT (US); Christian Daehler, Avon, CT (US); Shridhar Champaknath Nath, Niksayuna, NY (US); Anitha Bochala, Andhra Preadesh (IN)

(73) Assignee: General Electric Company, Schenectady, NY (US)

( * ) Notice: Subject to any disclaimer, the term of this patent is extended or adjusted under 35 U.S.C. 154(b) by 75 days.

(21) Appl. No.: 10/063,457

(22) Filed: Apr. 24, 2002

(65) Prior Publication Data

US 2003/0201857 A1 Oct. 30, 2003

(51) Int. Cl.[7] ..... H01H 9/00

(52) U.S. Cl. ..... 335/21; 335/172; 335/174; 335/176

(58) Field of Search ..... 335/6, 21–42, 335/172–176

(56) References Cited

U.S. PATENT DOCUMENTS 3,629,747 A * 12/1971 Findley, Jr. ..... 335/174
4,697,163 A 9/1987 Grunert et al. ..... 335/174
4,973,928 A 11/1990 Grunert ..... 335/38
5,453,724 A 9/1995 Seymour et al. ..... 335/172
5,670,922 A 9/1997 Montague et al. ..... 335/35
5,677,657 A 10/1997 Bagalini ..... 335/172
5,894,257 A * 4/1999 Roger et al. ..... 335/172
6,218,920 B1 4/2001 Reichard et al. ..... 335/176

* cited by examiner

*Primary Examiner*—Ramon M. Barrera
(74) *Attorney, Agent, or Firm*—Cantor Colburn LLP

(57) ABSTRACT

A magnetic trip unit for actuating a latching mechanism to trip a circuit breaker upon an overcurrent condition, the magnetic trip unit includes: a flux return component in electromagnetic communication with an electrically conductive strap; a tube disposed within the flux return component; a stator disposed at a first end of the tube and connected to the flux return component, the stator having a stator surface at one end; and a plunger slidably extending from a second end of the tube, the plunger comprises a plunger surface at one end facing the stator surface, the plunger further includes another end adapted to operably interact with the latching mechanism, the plunger is biased to a predetermined gap position.

17 Claims, 6 Drawing Sheets

MAGNETIC DEVICE FOR A MAGNETIC TRIP UNIT

BACKGROUND OF INVENTION

Circuit breakers typically provide protection against the very high currents produced by short circuits. This type of protection is provided in many circuit breakers by a magnetic trip unit, which trips the circuit breaker's operating mechanism to open the circuit breaker's main current-carrying contacts upon a short circuit condition.

Modern magnetic trip units include a magnet yoke (anvil) disposed about a current carrying strap, an armature (lever) pivotally disposed near the anvil, and a spring arranged to bias the armature away from the magnet yoke. Upon the occurrence of a short circuit condition, high currents pass through the strap. The increased current causes an increase in the magnetic field about the magnet yoke. The magnetic field acts to rapidly draw the armature towards the magnet yoke, against the bias of the spring. As the armature moves towards the yoke, the end of the armature contacts a trip lever, which is mechanically linked to the circuit breaker operating mechanism. Movement of the trip lever trips the operating mechanism, causing the main current-carrying contacts to open and stop the flow of electrical current to a protected circuit.

Magnetic trip units used within circuit breakers as described above must be compact and reliable. In addition, such magnetic trip units must be adjustable to vary the level of overcurrent at which the circuit breaker trips. This adjustment is often attained by varying the distance between the magnet yoke and the armature. However, the trip set point range offered by adjusting the distance between the magnet yoke and the armature is limited due to the finite space inside the circuit breaker housing. In order to provide overcurrent protection for a wide range of trip set points desired for motor protection, manufacturers typically offer a selection of circuit breakers having different trip set point ranges—one circuit breaker offering a lower spectrum range of trip set points and a second circuit breaker offering a higher spectrum range of trip set points. Often times, however, a customer will choose a circuit breaker having an improper trip set point range for a particular application. In addition, costs associated with manufacturing and inventory are increased having two different circuit breakers in order to offer a circuit breaker that offers motor protection over a wide trip set point range. Therefore, it is desired that magnetic trip units offer a broader spectrum of overcurrent ranges (e.g., for use in motor protection), so that a single circuit breaker can offer a broader trip set point range to reliably trip at different levels of overcurrent.

SUMMARY OF INVENTION

The above and other drawbacks and deficiencies are overcome or alleviated by a magnetic trip unit for actuating a latching mechanism to trip a circuit breaker upon an overcurrent condition, the magnetic trip unit includes: an electrically conductive strap; a flux return component in electromagnetic communication with the electrically conductive strap; a tube disposed within the flux return component; a stator disposed at a first end of the tube and connected to the flux return component, the stator having a stator surface at one end; and a plunger slidably extending from a second end of the tube, the plunger comprises a plunger surface at one end facing the stator surface, the plunger further includes another end adapted to operably interact with the latching mechanism, the plunger is biased to a predetermined gap position.

BRIEF DESCRIPTION OF DRAWINGS

Referring to the drawings wherein like elements are numbered alike in the several Figures.

DETAILED DESCRIPTION

Figure 1:
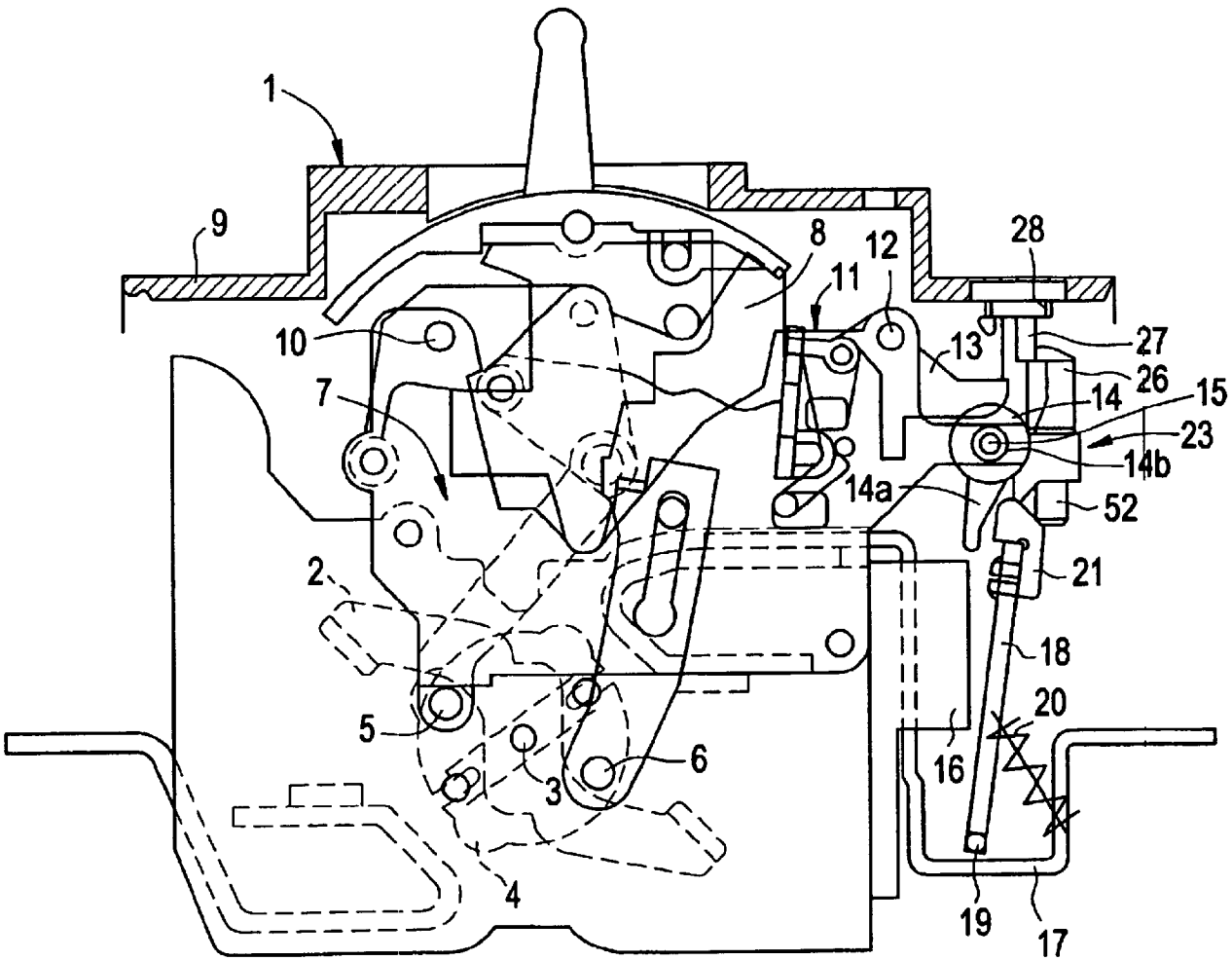
FIG. 1 PRIOR ART
FIG. 1 is an elevation view of a circuit breaker with a magnetic trip unit of the prior art.

A circuit breaker 1 equipped with an adjustable magnetic trip unit of the prior art is shown in FIG. 1. The circuit breaker 1 has a rotary contact arm 2, which is mounted on an axis 3 of a rotor 4 such that it can rotate. The rotor 4 itself is mounted in a terminal housing or cassette (not shown) and has two diametrically opposed satellite axes 5 and 6, which are also rotated about axis 3 when rotor 4 rotates. Axis 5 is the point of engagement for a linkage 7, which is connected to a latch 8. Latch 8 is mounted, such that it can pivot, on an axis 10 positioned on a circuit breaker housing 9. In the event of an overcurrent or short circuit condition, latch 8 is released by a latching mechanism 11, moving contact arm 2 to the open position shown in FIG. 1.

The latching mechanism 11 can be actuated by a trip lever 13 that pivots about an axis of rotation 12. The other end of trip lever 13 contacts a trip shaft 14, which is mounted on an axis 15 supported by circuit breaker housing 9. Disposed on trip shaft 14 is either a cam, arm or lever 14*a*, which can be pivoted clockwise in opposition to the force of a torsional spring 14*b* wound about axis 15.

Mounted to circuit breaker housing 9 in the bottom region of the circuit breaker is a rotational type magnetic assembly comprising a magnet yoke 16 and a biased armature element 18. Magnet yoke 16 encircles a current carrying strap 17 electrically connected to one of the contacts of circuit breaker 1. Arranged facing the magnet yoke is armature element 18 in the form of a metallic lever, which is hinge-mounted by means of hinge pin sections 19 to hinge knuckles (not shown) formed on circuit breaker housing 9. Armature 18 is also connected to strap 17 by a spring 20, which biases armature 18 in the clockwise direction, away from magnet yoke 16. In its upper region, armature 18 is equipped with a clip 21 rigidly mounted thereon, which can be brought into contact with arm or lever 14*a* by pivoting of armature 18 in a counter-clockwise direction. Movement of arm or lever 14*a* by armature 18 causes trip shaft 14 to rotate about axis 15 and thereby actuate latching mechanism 11 by means of trip lever 13. Once actuated, latching mechanism 11 releases latch 8 to initiate the tripping process in circuit breaker 1. While clip 21 is described herein as being mounted to armature 18, clip 21 can also be formed as one piece with armature 18, preferably of metal.

Figure 2:
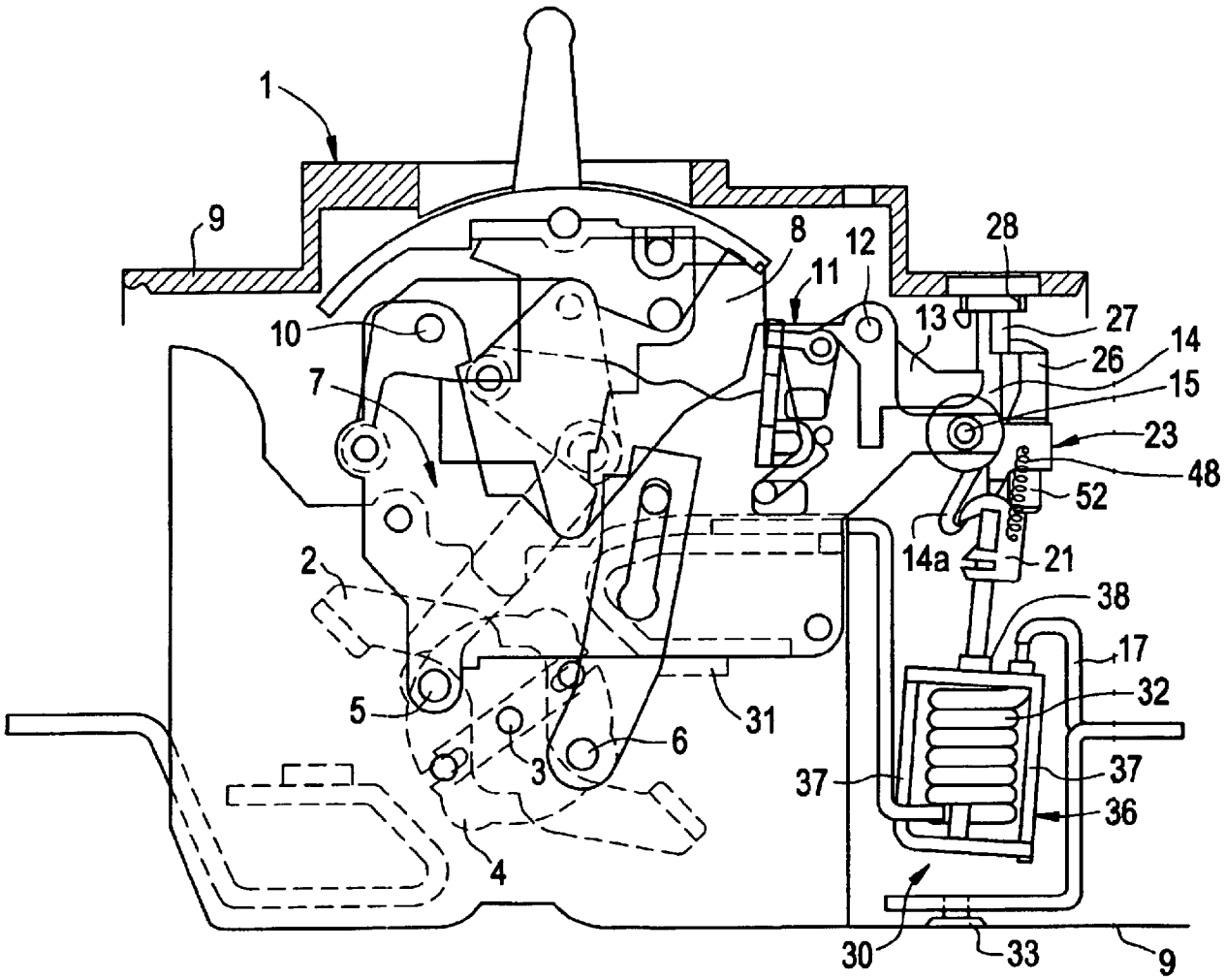
FIG. 2 is an elevation view of the circuit breaker of FIG. 1 with a magnetic trip unit of the present disclosure.

Referring now to FIG. 2, a linear solenoid magnetic trip unit assembly 30 of the present disclosure is disposed in circuit breaker 1 in lieu of the rotational magnetic trip assembly 30 discussed above as prior art. Linear solenoid magnetic trip unit assembly includes a flux return component 36. Flux return component 36 comprises a four sided enclosure that is configured using two generally "L" shaped metal brackets 37. Each bracket 37 has two ends, each end of one bracket 37 is configured to receive a complementary configured end of another bracket 37. Flux return component 36 surrounds a coil 32 having one end electrically connected to load strap 17 and another end electrically connected to a fixed contact 31 that is in electrical communication with rotary contact arm 2. Extending from an interior portion defined by coil 32 is a tube 38 having a plunger 42 slidably disposed therein and biased away from the top of coil 42 with a biasing member 48 (i.e., a spring) at an end of plunger 42 extending from tube 38. Biasing member 48 at one end is attached to clip 21 and to block 23 at the other end. Clip 21 is configured to engage lever 14*a* when plunger 42 translates downward against the bias of biasing member 48. It will be noted that flux return component 36 can optionally include any enclosure that is magnetically conductive and not in contact with coil 32. Flux return component 36 provides a magnetic path for magnetic flux that is generated when coil 32 conducts electricity. A portion of load strap 17 is optionally secured to circuit breaker housing 9 with a screw 33 shown in phantom.

Figure 3:
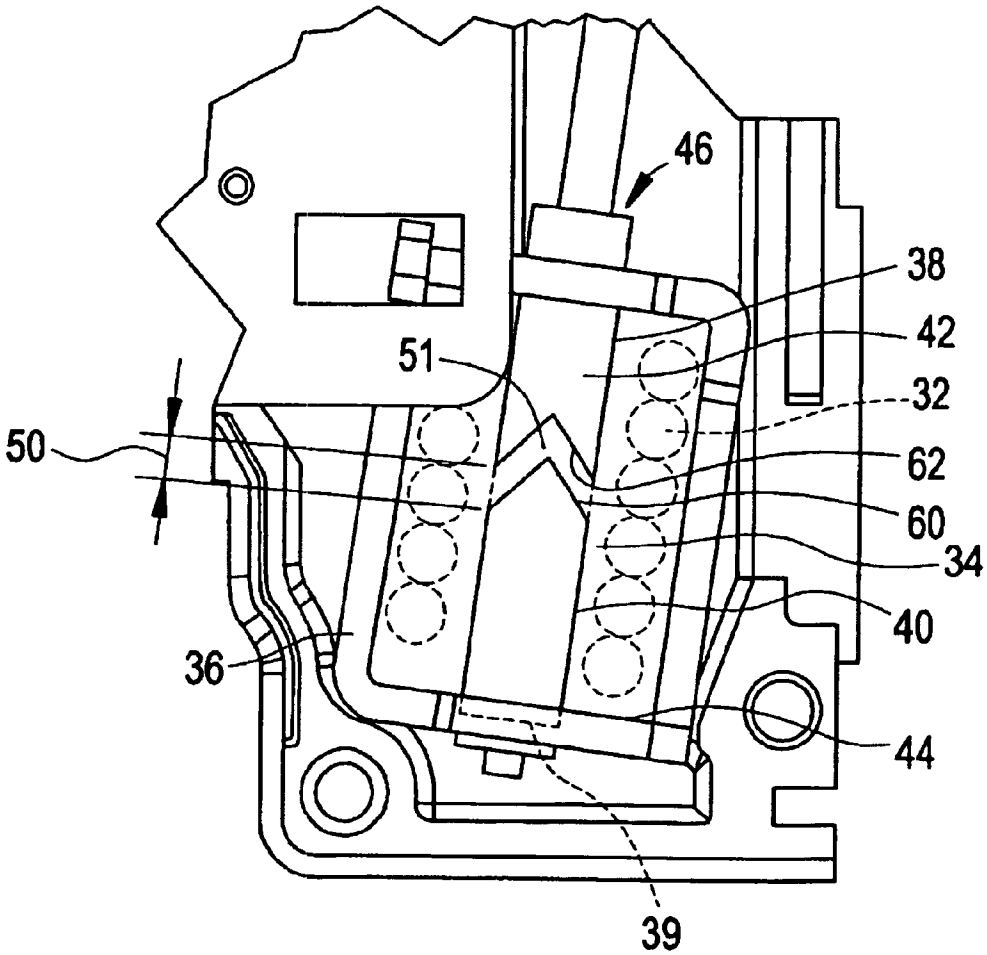
FIG. 3 is a partial cross sectional view of the magnetic trip unit of FIG. 2 showing a concave plunger disposed in a tube surrounded by a coil shown with phantom lines.

Turning to FIG. 3, an enlarged partial cross sectional view of magnetic trip unit assembly 30 in FIG. 2 illustrates the interior portion of coil 32 defining a cavity 34 therein. Flux return component 36 further includes a recess 39 (shown in phantom lines) for tube 38 to extend therefrom in a bottom portion 44 of flux return component 36. A stator 40 is disposed within tube 38 proximate recess 39. Tube 38, in turn, is arranged within cavity 34 defined by coil 32, shown with phantom lines. Further, plunger 42 extends through tube 38 and through an opening 46 of flux return component 36. In a preferred embodiment, tube 38 comprises a brass tube or other suitable material.

Referring to FIGS. 2 and 3, biasing member 48 urges plunger 42 to a predetermined position, wherein facing surfaces 62, 60 of plunger 42 and stator 40, respectively, form a gap 50 therebetween. As seen in FIG. 2, plunger 42 is shown in communication with arm or lever 14*a* to actuate trip shaft 14 to initiate a trip when plunger 42 translates toward stator 40.

Gap 50 is adjusted utilizing biasing member 48 to bias plunger 42 away from stator 40. A means for limiting translation or means for preventing further translation away from stator 40 positions plunger 42 in the predetermined position is utilized such that plunger 42 can only translate towards stator 40 against the bias of the spring. The means to prevent further translation away from stator 40 and the same means for setting gap 50 optionally includes, but is not limited to, adjusting arm 52. Adjusting arm 52 is threadably received in block 23 such that arm 52 engages the top portion of plunger 42 preventing further translation of plunger 42 away from stator 40. Adjusting arm 52 is turned in either direction that acts as an adjustable stop for plunger 42 which sets gap 50. As will be appreciated, assembly 30 having plunger 42 may be operably coupled in numerous manners to existing trip latch mechanisms to initiate a mechanical trip signal from plunger 42. In addition, clip 21 may optionally be integrally configured as part of the top portion of plunger 42.

Figure 4:
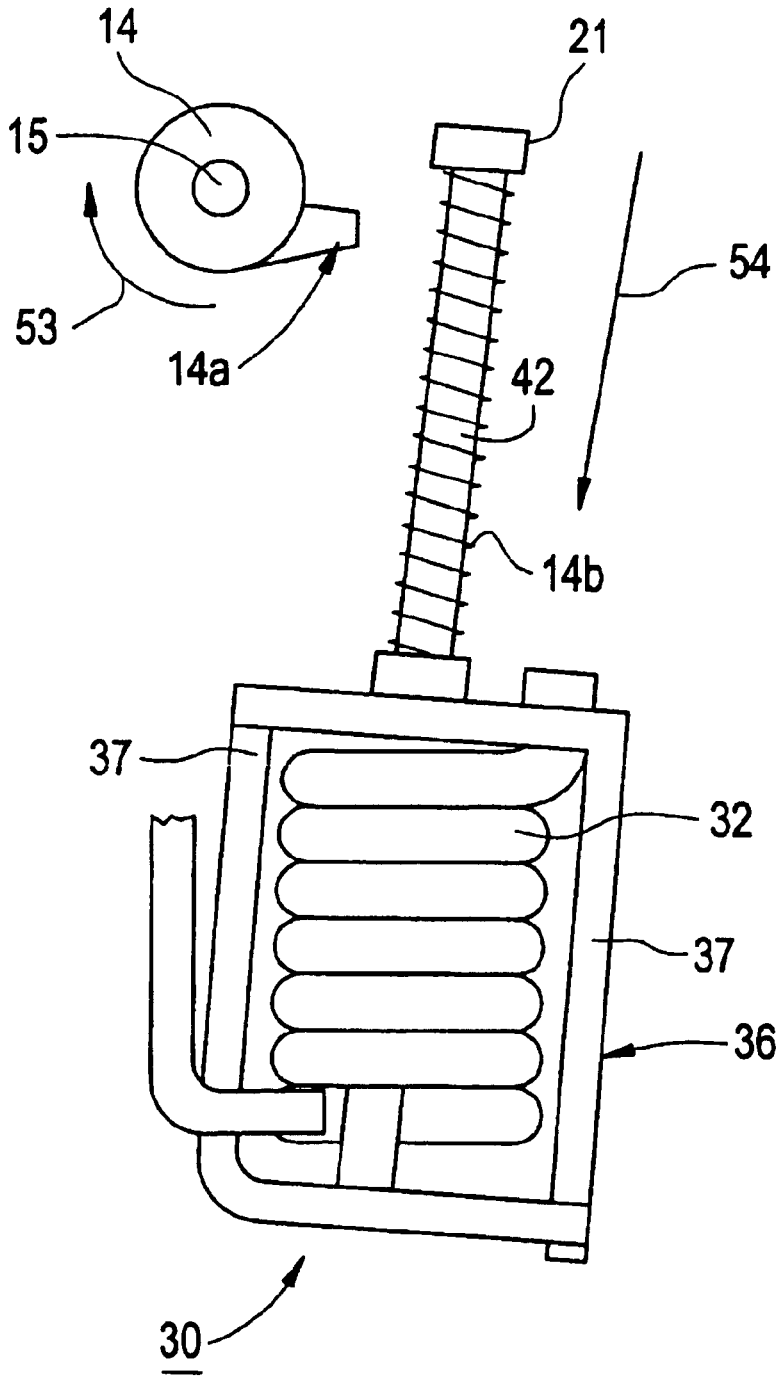
FIG. 4 is an alternative embodiment of a magnetic trip unit of FIG. 2.

Referring to FIG. 4, an alternative embodiment of clip 21 and trip lever 14*a* shown in FIG. 2 are depicted. Trip shaft 14 is actuated when clip 21 is attached to plunger 42 and pushes arm or lever 14*a* in a clockwise direction 53 when plunger 42 translates in a direction 54 toward stator 40 against the bias of biasing member 48 in tension that is operably coupled to clip 21. Clip 21 is configured to attach to a top portion of plunger 42. Biasing member 48 optionally includes a compression spring disposed intermediate clip 21 and flux return component 36.

Under normal operating conditions, current flows through coil 32 and generates a distance dependent electromagnetic force which attracts plunger 42 toward stator 40. An opposing force is generated by biasing member 48 acting to bias plunger 42 in the predetermined position providing a predetermined gap 50 between a plunger-stator interface 51. The predetermined position of plunger 42 is optionally set utilizing adjusting arm 52 to set clip 21 and thus plunger 42 in the predetermined position. When slight overcurrents occur of a value less than that of a predetermined magnitude for tripping the circuit breaker, any resulting increases in the electromagnetic force applied by stator 40 upon plunger 42 are resisted and absorbed by return spring 48 up to the force corresponding to the predetermined magnitude established for tripping.

However, when an overcurrent of a predetermined magnitude occurs, an electromagnetic force of sufficient value pulls plunger 42 downwardly towards stator 40 against the bias of biasing member 48 causing plunger 42 to translate down in direction 54. As a result, referring to FIG. 2 in one example, clip 21 connected to a top portion of plunger 42, causes arm or lever 14*a* to rotate clockwise causing latching mechanism 11 to release latch 8 and initiate the tripping process in circuit breaker 1. Thus, biasing member 48 suppresses transient overcurrents to prevent nuisance tripping of the circuit breaker.

Referring again to FIG. 3, an induced magnetic force acting on plunger 42 varies depending on the level of current in coil 32, representative of the current being drawn from the load circuit connected to load strap 17, and gap 50 between plunger 42 and stator 40. If the induced force acting on plunger 42 is greater than the return biasing member 48 force, plunger 42 accelerates towards stator 40 and stator 40 receives plunger 42.

Figure 5:
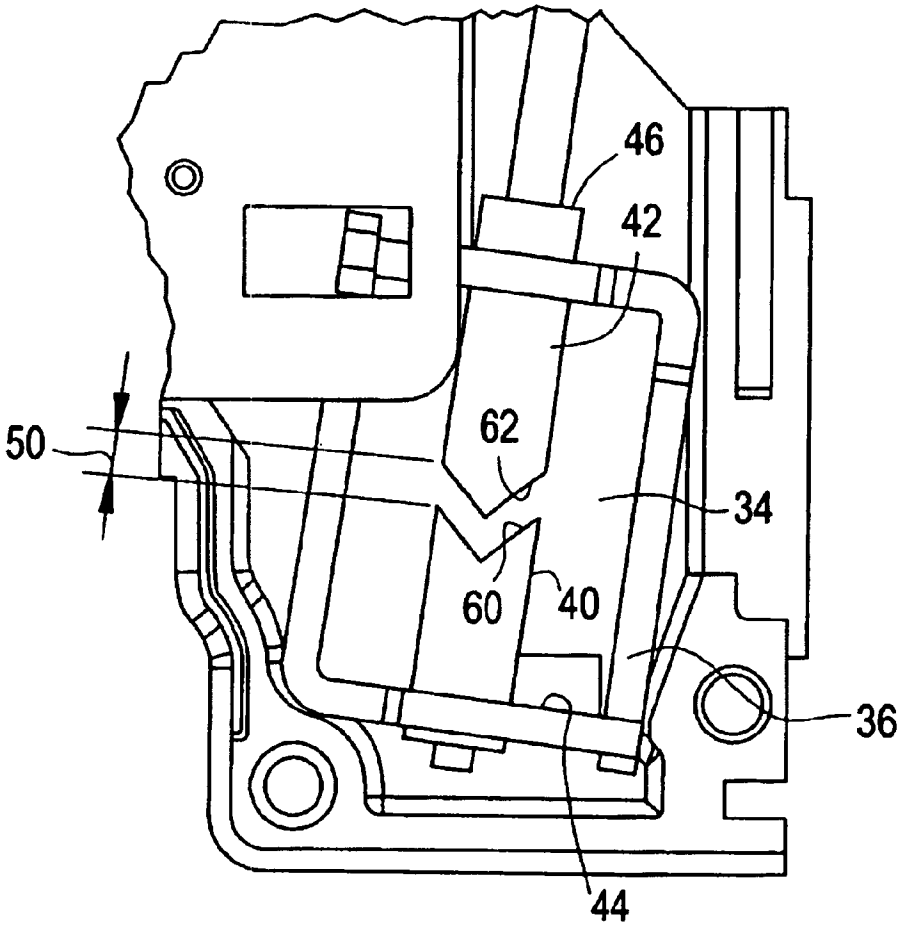
FIG. 5 is an alternative embodiment of the magnetic trip unit in FIG. 3 showing a convex plunger disposed inside the tube.

Referring to an alternative embodiment in FIG. 5, plunger 42 has a surface 62 facing a surface 60 of stator 40, both surfaces 60, 62 each having a specific configuration complementary to the other. More specifically, surface 60 of stator 40 is configured having a concave conical end (e.g., funnel-shaped) while surface 62 of plunger 42 having a complementary engaging convex conical end. It will be noted that stator 40 and plunger 42 in FIG. 5 are oppositely configured to the stator 40 and plunger 42 in FIG. 3. Plunger 42 in FIG. 3 is referred to as a "female" plunger 42 and the plunger in FIG. 3 is referred to as a "male" plunger 42. As is known in the art, the magnetic gradient is known to rapidly decrease in magnetic force as gap 50 increases between plunger 42 and stator 40 facing surfaces. The magnetic gradient, however, is known to decrease at a lesser rate using conical surfaces as opposed to planar surfaces. It will be appreciated that, when coil 32 carries current, plunger 42 has a tendency to be pulled towards stator 40, thereby reducing gap 50 between plunger 42 and stator 40. This has the effect of increasing the force during the time plunger 42 is moving towards stator 40, thus positively finishing the process of tripping once plunger 42 has started moving. In other words, the increase in the induced magnetic force acting on plunger 42 increases exponentially as gap 50 decreases while an opposite force by biasing member 48 increases linearly, dependent on the spring constant of biasing member 48 as gap 50 decreases.

Figure 6:
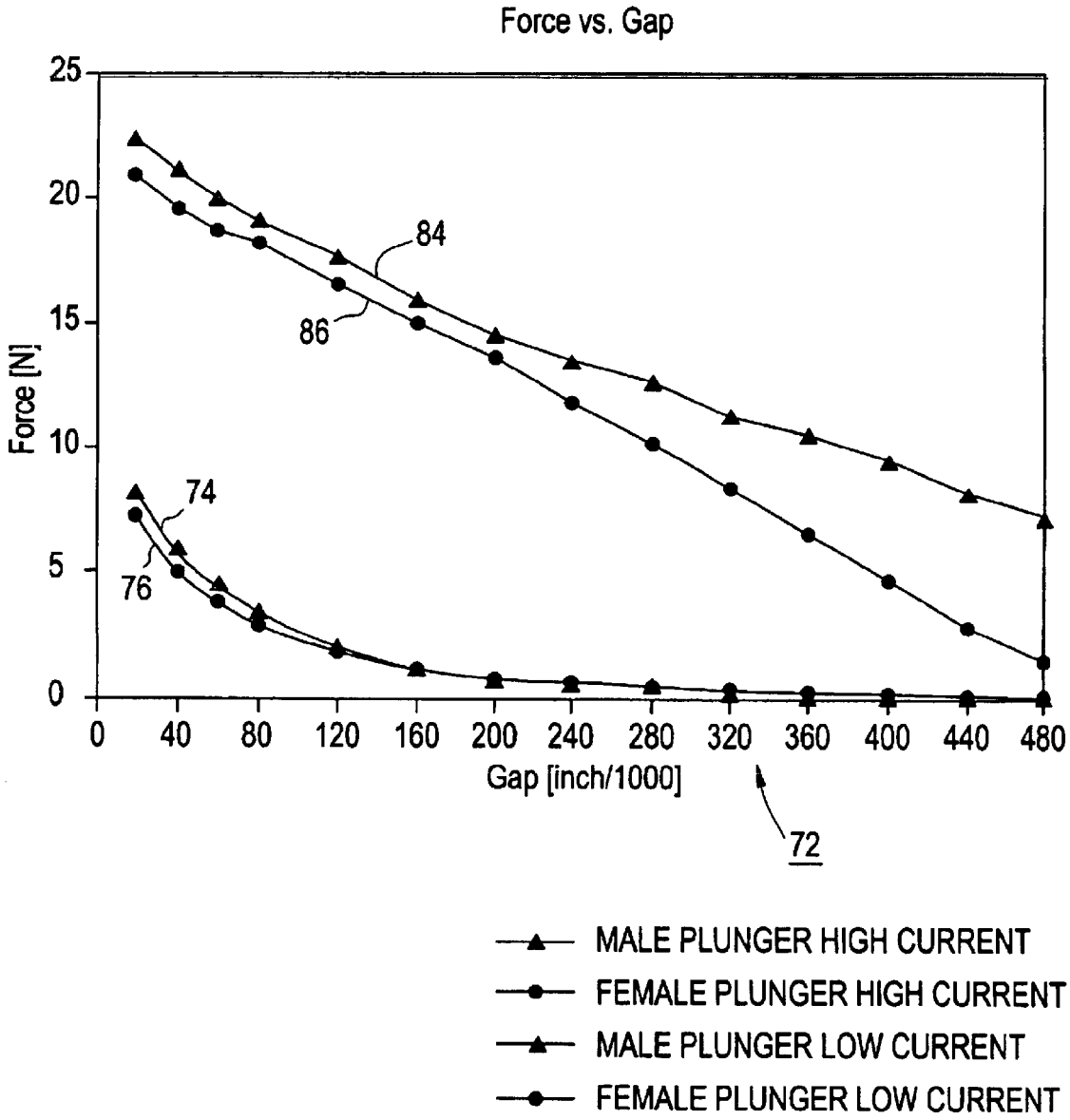
FIG. 6 is a graph illustrating the relationship between the induced force and gap of two different plunger configurations.

In FIG. 6 of the drawings, a force versus gap graph 72 shows a plunger electro-magnetic force characteristic tested with two different load currents present in coil 32 and utilizing two different complementary plunger-stator interface configurations. In each case tested, a fifteen-ampere, eighteen turn coil was utilized. Curves 74 and 76 show two force versus gap curves at three times the rated current, and curves 84 and 86 show two force versus gap curves at twenty times the rated current, respectively. Curves 74 and 84 represent the force characteristic for a convex conical plunger 42 shown in FIG. 5, while curves 76 and 86 show the behavior of a concave conical plunger 42 shown in FIG. 3.

Plunger 42 having a concave conical surface facing a complementary convex conical stator 40 results in a lower induced force for a particular gap 50 compared to plunger 42 having a convex conical surface facing a concave conical stator (i.e. opposite configuration). This is especially pronounced relative to larger gaps 50 as seen with curves 84, 86 (twenty times the rated current). The reduced induced force reduces the gap 50 necessary to allow for a preferred range for motor protection to extend to about twenty times the rated current. More specifically, when gap 50 setting is 0.44 inch, the induced force on the concave conical plunger 42 is about 3 Newtons compared with an induced force of about 8 Newtons utilizing a convex conical 42. An induced force of 8 Newtons on the concave conical plunger 42 occurs at gap 50 of about 0.32 inch instead of 0.44 inch, as in the case of a convex conical plunger. Therefore, gap 50 can be smaller utilizing concave conical plunger 42 that results in an induced force that is achieved when gap 50 is larger using a convex conical plunger 42 and current through coil 32 is the same in both instances.

Another significant characteristic to note between concave conical plunger 42 and convex conical plunger 42 occurs at small gaps 50. For example, referring to FIG. 6 and curves 84 and 86, the induced force acting on plunger 42 at a gap 50 of 0.08 inch is approximately the same (i.e., about 18 Newtons for the concave conical plunger 42 and 19 Newtons for the convex conical plunger 42). In reference to a maximum trip current setting at small gaps 50, the concave conical and convex conical configured plungers 42 have similar induced forces acting thereon. At large gaps 50, the induced force is much less as gap 50 increases. The concave conical configuration of plunger 42 and complementary shaped stator 40 of the present disclosure allows for generally similar induced magnetic forces at low currents, minimum trip setting as the convex conical configuration. The concave conical configuration of plunger 42 and complementary shaped stator 40 also provides a linear relationship and maximization of the slope between the induced force and gap relationship at high currents, maximum trip current setting, thereby extending the effective range to about twenty times the rated current without utilizing a larger gap 50 setting to obtain a twenty times the rated current trip setting. It is noteworthy that there is little difference, if at all between the induced forces acting on a convex conical plunger 42 versus a concave conical plunger 42 when comparing these forces in relation to a gap 50 for the minimum trip current curves 74, 76. Heretofore, as far as the applicant is aware, expensive electronic devices have been necessary to provide the required overload protection while still allowing high start-up currents.

The gap distance and the surface configurations between the plunger-stator interface determine the force acting on the plunger created by the induced magnetic force in the assembly. With the selection of the configurations for the plunger-stator interface, as described above, a linear solenoid magnetic-type circuit breaker is provided that provides the necessary overload protection over a broad range of trip point settings. Hence, the need for expensive electronic devices or choosing a circuit breaker with a proper adjustable trip set point range for motor protection is obviated.

It will be understood that a person skilled in the art may make modifications to the preferred embodiment shown herein within the scope and intent of the claims. While the present invention has been described as carried out in a specific embodiment thereof, it is not intended to be limited thereby but is intended to cover the invention broadly within the scope and spirit of the claims.

What is claimed is:

1. A magnetic trip unit for actuating a latching mechanism to trip a circuit breaker upon an overcurrent condition, the magnetic trip unit including:

an electrically conductive strap;

a flux return component in electromagnetic communication with said electrically conductive strap;

a tube disposed within said flux return component;

a stator disposed at a first end of said tube connected to said flux return component, said stator having a stator surface at one end; and a plunger slidably extending from a second end of said tube, said plunger includes a plunger surface at one end facing said stator surface, said plunger further includes another end adapted to operably interact with the latching mechanism said plunger is biased to a predetermined position, wherein said plunger surface comprises a concave comical surface and said stator surface comprises a complementary convex conical surface to operably receive said plunger surface.

2. The magnetic trip unit of claim 1, wherein said predetermined position is defined by a gap between said plunger surface and said stator surface.

3. The magnetic trip unit of claim 2, wherein said plunger surface and said stator surface are each configured having a complementary conical shape, said complementary conical shape providing a generally linear relationship between said gap and an induced magnetic force acting on said plunger at large gaps relative to small gaps.

4. The magnetic trip unit of claim 1, wherein said flux return component includes a coil disposed around said tube in electrical communication with said electrically strap.

5. The magnetic trip unit of claim 1, wherein said bias includes a biasing member operably connected to said plunger, said biasing member biasing said plunger away from said stator.

6. The magnetic trip unit of claim 1, wherein said bias includes a spring biasing said plunger away from said stator, said plunger is biased in a predetermined position by a means for limiting further translation of said plunger away from said stator.

7. The magnetic trip unit of claim 6, wherein maid means for limiting further translation includes setting said gap between said plunger surface and said stator surface.

8. A circuit breaker including:

a first contact arm arranged between first and second electrically conductive straps;

a latching mechanism configured to move said first contact arm out of contact with said first and second electrically straps; and a magnetic trip unit for actuating said latching mechanism to trip the circuit breaker upon an overcurrent condition, the magnetic trip unit including:

a flux return component in electromagnetic communication with said first electrically conducting strap;

a tube disposed within said flux return component;

a stator disposed at a first end of said tube connected to said flux return component, said stator having a stator surface at one end; and a plunger slidably extending from a second end of said tube, said plunger comprises a plunger surface at one end facing said stator surface, said plunger further includes another end adapted to operably interact with said latching mechanism, said plunger is biased in a predetermined position, wherein said plunger surface comprises a concave conical surface and said stator surface comprises a complementary convex conical surface to operably receive said plunger surface.

9. The circuit breaker of claim 8, wherein said predetermined position is defined by a gap between said plunger surface and said stator surface.

10. The circuit breaker of claim 9, wherein said plunger surface and said stator surface are each configured having a complementary conical shape, said complementary conical shape providing a generally linear relationship between said gap and an induced magnetic force acting on said plunge at large gaps relative to small gaps.

11. The circuit breaker of claim 8, wherein said flux return component includes a coil disposed around said tube in electrical communication with said first electrically conductive strap.

12. The circuit breaker of claim 8, wherein said bias includes a biasing member operably connected to said plunger, said biasing member biasing said plunger away from said stator.

13. The circuit breaker of claim 8, wherein said bias includes a spring biasing said plunger away from said stator, said plunger is biased in a predetermined position by a means for limiting further translation of said plunger away from said stator.

14. The circuit breaker of claim 13, wherein said means for limiting further translation includes setting said gap between said plunger surface and said stator surface.

15. A magnetic trip unit for actuating a latching mechanism to trip a circuit breaker upon an overcurrent condition, the magnetic trip unit including:

an electrical conductive strap;

a flux return component in electromagnetic communication with said electrically conductive strap;

a tube disposed within said flux return component;

a stator disposed at a first end of said tube connected to said flux return component, said stator having a stator surface at one end; and a plunger slidably extending from a second end of said tube, said plunger includes a plunger surface at one end facing said stator surface, said plunger further includes another end adapted to operably interact with the latching mechanism, said plunger is biased to a predetermined position, wherein mating pole faces of said plunger and said stator are non-planar and complementary configured with respect to each other, said complementary configured mating pole faces of said plunger and said stator are non-planar relative to a plane orthogonal to a direction of travel of said plunger.

16. The magnetic trip unit of claim 15, wherein said complementary configured mating pole faces of said plunger and said stator are at least one of acute and obtuse relative to plane orthogonal to a direction of travel of said plunger.

17. The magnetic trip unit of claim 15, wherein a majority of surface portions defining each of said complementary configured mating pole faces of said plunger as said stator are defined by planes that are at least one of acute and obtuse relative to a plane orthogonal to a direction of travel of said plunger.

* * * * *